US010816198B2

(12) United States Patent
Fujisawa et al.

(10) Patent No.: US 10,816,198 B2
(45) Date of Patent: Oct. 27, 2020

(54) COMBUSTOR AND GAS TURBINE

(71) Applicant: MITSUBISHI HITACHI POWER SYSTEMS, LTD., Kanagawa (JP)

(72) Inventors: Ryutaro Fujisawa, Tokyo (JP); Hikaru Kurosaki, Tokyo (JP); Noriyuki Okada, Tokyo (JP); Taiki Kinoshita, Kanagawa (JP); Hiroki Shibata, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 426 days.

(21) Appl. No.: 15/468,718

(22) Filed: Mar. 24, 2017

(65) Prior Publication Data

US 2017/0284670 A1 Oct. 5, 2017

(30) Foreign Application Priority Data

Mar. 31, 2016 (JP) ..... 2016-070458

(51) Int. Cl.
*F01D 9/00* (2006.01)
*F23R 3/00* (2006.01)
(Continued)

(52) U.S. Cl.
CPC ..... *F23R 3/002* (2013.01); *F01D 9/023* (2013.01); *F01D 11/005* (2013.01); *F23R 3/46* (2013.01);
(Continued)

(58) Field of Classification Search
CPC ..... F01D 9/023; F23R 2900/00012; F23R 2900/00005
See application file for complete search history.

(56) References Cited

U.S. PATENT DOCUMENTS 7,908,866 B2 3/2011 Kato et al.
2005/0241314 A1* 11/2005 Takaya ..... F01D 9/023 60/752
(Continued)

FOREIGN PATENT DOCUMENTS

| | | |
|---|---|---|
| JP | 5-96760 | 12/1993 |
| JP | 2006-284127 | 10/2006 |
| WO | 2006/109431 | 10/2006 |

OTHER PUBLICATIONS

Office Action dated Mar. 3, 2020 in corresponding Japanese Patent Application No. 2016-070458, with English Translation.

*Primary Examiner* — Gerald L Sung
(74) *Attorney, Agent, or Firm* — Wenderoth, Lind & Ponack, L.L.P.

(57) ABSTRACT

The present invention is a combustor provided with a combustor transition pipe connected to a turbine while interposing a transition pipe seal in between, including a flange portion provided at an end portion on a downstream side in a fluid flow direction of the combustor transition pipe, the flange portion projecting to radially inside and extending in a circumferential direction. The flange portion includes a pin hole into which a pin to position the transition pipe seal is inserted, a circumferential slit portion either extending within a range in a radial direction where the pin hole is formed or being located on radially outside of the pin hole and extending in the circumferential direction, and a hole portion on which part of the circumferential slit portion abuts.

4 Claims, 9 Drawing Sheets

(51) Int. Cl.

| | |
|---|---|
| ***F01D 9/02*** | (2006.01) |
| ***F01D 11/00*** | (2006.01) |
| ***F23R 3/60*** | (2006.01) |
| ***F23R 3/46*** | (2006.01) |

(52) U.S. Cl.
CPC ..... *F23R 3/60* (2013.01); *F05D 2240/57* (2013.01); *F23R 2900/00005* (2013.01); *F23R 2900/00012* (2013.01)

(56) References Cited

U.S. PATENT DOCUMENTS

| | | | | |
|---|---|---|---|---|
| 2007/0193248 | A1* | 8/2007 | Bessagnet | F23R 3/06 60/39.01 |
| 2008/0010989 | A1 | 1/2008 | Kato et al. | |
| 2008/0010997 | A1* | 1/2008 | Bessagnet | F23R 3/283 60/805 |
| 2011/0023496 | A1 | 2/2011 | Bastnagel et al. | |
| 2011/0048023 | A1* | 3/2011 | Patel | F02C 7/222 60/748 |
| 2013/0142631 | A1* | 6/2013 | Pauli | F01D 25/14 415/177 |
| 2015/0121884 | A1* | 5/2015 | Senofonte | F23R 3/002 60/752 |
| 2018/0030844 | A1* | 2/2018 | White | F01D 9/023 |

* cited by examiner

COMBUSTOR AND GAS TURBINE

TECHNICAL FIELD

The present invention relates to a combustor and a gas turbine.

BACKGROUND ART

A gas turbine is an internal combustion engine configured to obtain power by rotating a turbine with an expanded high-temperature combustion gas gained as a result of combustion of a fuel. Such a gas turbine includes: a compressor which compresses air; a combustor which combusts a mixture of a fuel and the compressed air generated by the compressor; and a turbine which rotates a rotor shaft by expanding the combustion gas generated by the combustor.

The gas turbine is designed to directly convert thermal energy generated by the compressor and the combustor into rotational kinetic energy. In order to achieve the energy conversion efficiently, flow passages on which fluids such as the compressed gas and the combustion gas flow are provided with various seal structures in order to prevent outflow (leakage) of the fluids from the flow passages.

For example, a transition pipe seal for preventing the leakage of the combustion gas is provided at a junction between the combustor and the turbine on a flow passage to feed the combustion gas. The transition pipe seal is attached to an end portion (a flange portion) of a combustor transition pipe located on the lowermost stream side in a fluid flow direction of the combustor and to an end portion (a flange portion) of a stator vane shroud located on the uppermost stream side in the fluid flow direction of the turbine. Moreover, positioning in a circumferential direction of the transition pipe seal is established by bringing the transition pipe seal into pinned connection to the flange portion of the combustor transition pipe. Here, the pinned connection of the transition pipe seal to the flange portion of the combustor transition pipe is achieved by inserting a pin into pin holes formed in the transition pipe seal and in the flange portion of the combustor transition pipe.

CITATION LIST

Patent Literature

{Patent Literature 1} Japanese Utility Model Registration Application Publication No. Hei 5-96760

SUMMARY OF INVENTION

Technical Problem

The combustor transition pipe is designed to combust the mixed gas prepared by mixing the compressed air and the fuel, and to guide the combustion gas generated by the combustion to the turbine located on the downstream side in the fluid flow direction. An inner peripheral side portion of the combustor transition pipe is always exposed to the high-temperature combustion gas while the gas turbine is in operation. In the meantime, at the flange portion of the combustor transition pipe, there is a region (a low-temperature region) to which the transition pipe seal is attached. This region is therefore not exposed to the high-temperature combustion gas even while the gas turbine is in operation. Moreover, there is another region (a high-temperature region) located in the vicinity of the position to which the transition pipe seal is attached. This region is prone to be exposed to the high-temperature combustion gas. In addition, the heat from the inner peripheral side portion is also likely to be transmitted to this region.

As a consequence, the flange portion of the combustor transition pipe causes thermal stress attributed to a difference in temperature between the low-temperature region and the high-temperature region. The thermal stress is caused by thermal strain in which a material constituting the flange portion of the combustor transition pipe is pulled from the low-temperature region to the high-temperature region. Hence, large thermal stress (stress concentration) occurs at a rim of the pin hole.

The stress concentration on the rim of the pin hole occurs during the operation of the gas turbine when there are the low-temperature region and the high-temperature region in the flange portion. On the other hand, the thermal stress or the stress concentration does not occur when the gas turbine is stopped. Accordingly, when the gas turbine is repeatedly operated and stopped, cyclic fatigue (low-cycle fatigue) occurs at the rim of the pin hole.

Note that Patent Literature 1 describes a technique related to a sheet-metal structure member which is disposed along a high-temperature gas flow passage and is used under a high temperature to be repeatedly subjected to the thermal stress. However, this technique aims to cause a stop hole, which is formed at an inner end portion of a slit provided for thermal stress absorption, to fully exert its function in the case where there is no stress concentration on portions on the periphery of the stop hole. Accordingly, this technique does not intend to relax the thermal stress in the vicinity of the pin hole in the flange portion of the combustor transition pipe.

The present invention has been made in view of the above-mentioned problem. An object of the invention is to relax thermal stress in the vicinity of a pin hole in a flange portion of a combustor transition pipe and thus to reduce cyclic fatigue.

Solution to Problem

A combustor according to a first aspect of the present invention which solves the above-mentioned problem is a combustor provided with a combustor transition pipe connected to a turbine while interposing a transition pipe seal in between, including a flange portion provided at an end portion on a downstream side in a fluid flow direction of the combustor transition pipe, the flange portion projecting to radially inside and extending in a circumferential direction. The flange portion includes a pin hole into which a pin to position the transition pipe seal is inserted, a circumferential slit portion either extending within a range in a radial direction where the pin hole is formed or being located on radially outside of the pin hole and extending in the circumferential direction, and a hole portion on which part of the circumferential slit portion abuts.

A combustor according to a second aspect which solves the above-mentioned problem is the combustor according to the first aspect, in which the flange portion includes a plurality of radial slit portions each abutting on a rim on the radially inside of the flange portion and extending in the radial direction, the radial slit portions are formed symmetrically in the circumferential direction with respect to the pin hole, and each radial slit portion is formed at a predetermined distance away in the circumferential direction from the pin hole, a plurality of the circumferential slit portions are formed symmetrically in the circumferential direction with respect to the pin hole, and each circumferential slit portion is formed such that one end of the circumferential slit portion is connected to an end portion on the radially outside of the corresponding radial slit portion, and the circumferential slit portion extends in the circumferential direction and in a direction away from the pin hole, and a plurality of the hole portions are formed symmetrically in the circumferential direction with respect to the pin hole, and such that another end portion of each circumferential slit portion abuts on the corresponding hole portion.

A combustor according to a third aspect which solves the above-mentioned problem is the combustor according to the second aspect, in which the flange portion includes a curved slit portion formed into a curve and provided at a junction between each radial slit portion and the corresponding circumferential slit portion.

A combustor according to a fourth aspect which solves the above-mentioned problem is the combustor according to the first aspect, in which the flange portion includes a radial slit portion abutting on a rim on the radially inside of the flange portion and extending in the radial direction, and the radial slit portion is formed at the same position in the circumferential direction as the pin hole, such that one end of the radial slit portion abuts on pin hole.

A combustor according to a fifth aspect which solves the above-mentioned problem is the combustor according to the fourth aspect, in which a plurality of the circumferential slit portions are formed symmetrically in the circumferential direction with respect to the pin hole, and each circumferential slit portion is formed such that one end of the circumferential slit portion abuts on the pin hole, and a plurality of the hole portions are formed symmetrically in the circumferential direction with respect to the pin hole, and such that another end portion of each circumferential slit portion abuts on the corresponding hole portion.

A gas turbine according to a sixth aspect which solves the above-mentioned problem includes the combustor according to the third aspect.

A gas turbine according to a seventh aspect which solves the above-mentioned problem includes the combustor according to the fifth aspect.

Advantageous Effects of Invention

According to the combustor of the first aspect of the present invention, a difference in thermal strain (thermal stress) occurring at the flange portion is relaxed by the circumferential slit portion. Thus, it is possible to relax the thermal stress in the vicinity of the pinhole and to reduce cyclic fatigue (low-cycle fatigue)

According to the combustor of the second aspect of the present invention, the radial slit portions can reliably relax the thermal stress in the vicinity of the pin hole and reduce the cyclic fatigue (the low-cycle fatigue). In addition, it is possible to avoid stress concentration on a portion not in the vicinity of the pin hole by use of the circumferential slit portions connected to the radial slit portions and of the hole portions on which the circumferential slit portions abut.

According to the combustor of the third aspect of the present invention, it is possible to avoid the stress concentration on a junction between any of the radial slit portions and the corresponding circumferential slit portion.

According to the combustor of the fourth aspect of the present invention, the flange portion is split in the circumferential direction in the vicinity of the pin hole. Thus, it is possible to relax an action of the thermal stress in the circumferential direction in the vicinity of the pin hole and to reduce the cyclic fatigue (the low-cycle fatigue).

According to the combustor of the fifth aspect of the present invention, the difference in thermal strain (thermal stress) occurring at the flange portion is relaxed by the circumferential slit portions. Thus, it is possible to relax the thermal stress in the vicinity of the pin hole and to reduce the cyclic fatigue (the low-cycle fatigue).

According to the gas turbine of the sixth aspect of the present invention, it is possible to relax the thermal stress on the flange portion of the combustor transition pipe connected to the turbine while interposing the transition pipe seal in between, and to reduce the cyclic fatigue (the low-cycle fatigue). Thus, it is possible to extend component replacement cycles, a maintenance cycle, and the like.

DESCRIPTION OF EMBODIMENTS

An embodiment of a gas turbine including a combustor according to the present invention will be described below in detail with reference to the accompanying drawings. It is needless to say that the present invention is not limited only to the following embodiment, and various modifications are possible within a range not departing from the gist of the present invention.

First Embodiment

A structure of a gas turbine including a combustor according to a first embodiment of the present invention will be described with reference to FIGS. 1 to 5A.

Figure 1:
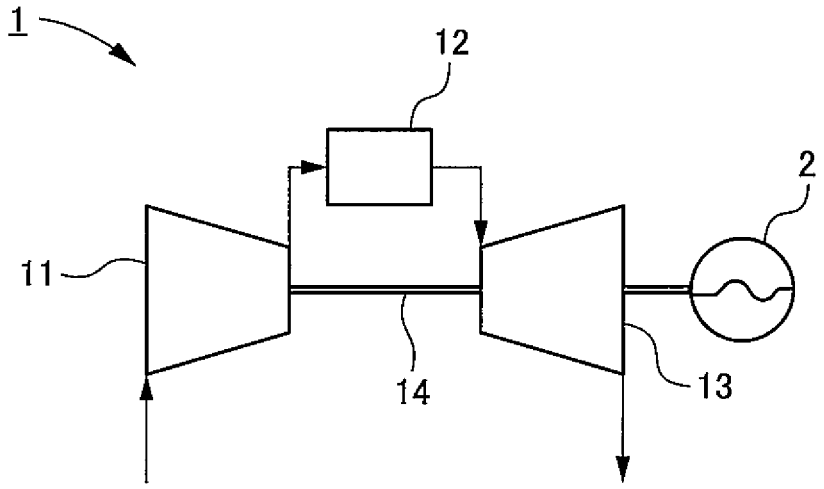
FIG. 1 is an explanatory diagram showing a structure of a gas turbine including a combustor according to a first embodiment of the present invention.

As shown in FIG. 1, a gas turbine 1 includes a compressor 11 which takes in and compresses outside air. A turbine 13 is provided, through the intermediary of a combustor 12, on a downstream side in a fluid flow direction (see arrows in FIG. 1) of the compressor 11. The compressed air generated by the compressor 11 is mixed with a fuel in the combustor 12 and then combusted. Combustion gas thus generated by the combustor 12 is expanded in the turbine 13 and used to rotate a rotor shaft (rotation shaft) 14.

The gas turbine 1 is juxtaposed to a power generator 2. The power generator 2 is provided coaxially with the rotor shaft 14 of the gas turbine 1. In other words, the power generator 2 is mechanically connected to the rotor shaft 14, whereby rotational motion of the rotor shaft 14 is transmitted to the power generator 2. Accordingly, thermal energy generated by the compressor 11 and the combustor 12 of the gas turbine 1 is converted into rotational kinetic energy for the rotor shaft 14 by the turbine 13, and the rotational kinetic energy is converted into electric energy by the power generator 2.

Figure 2:
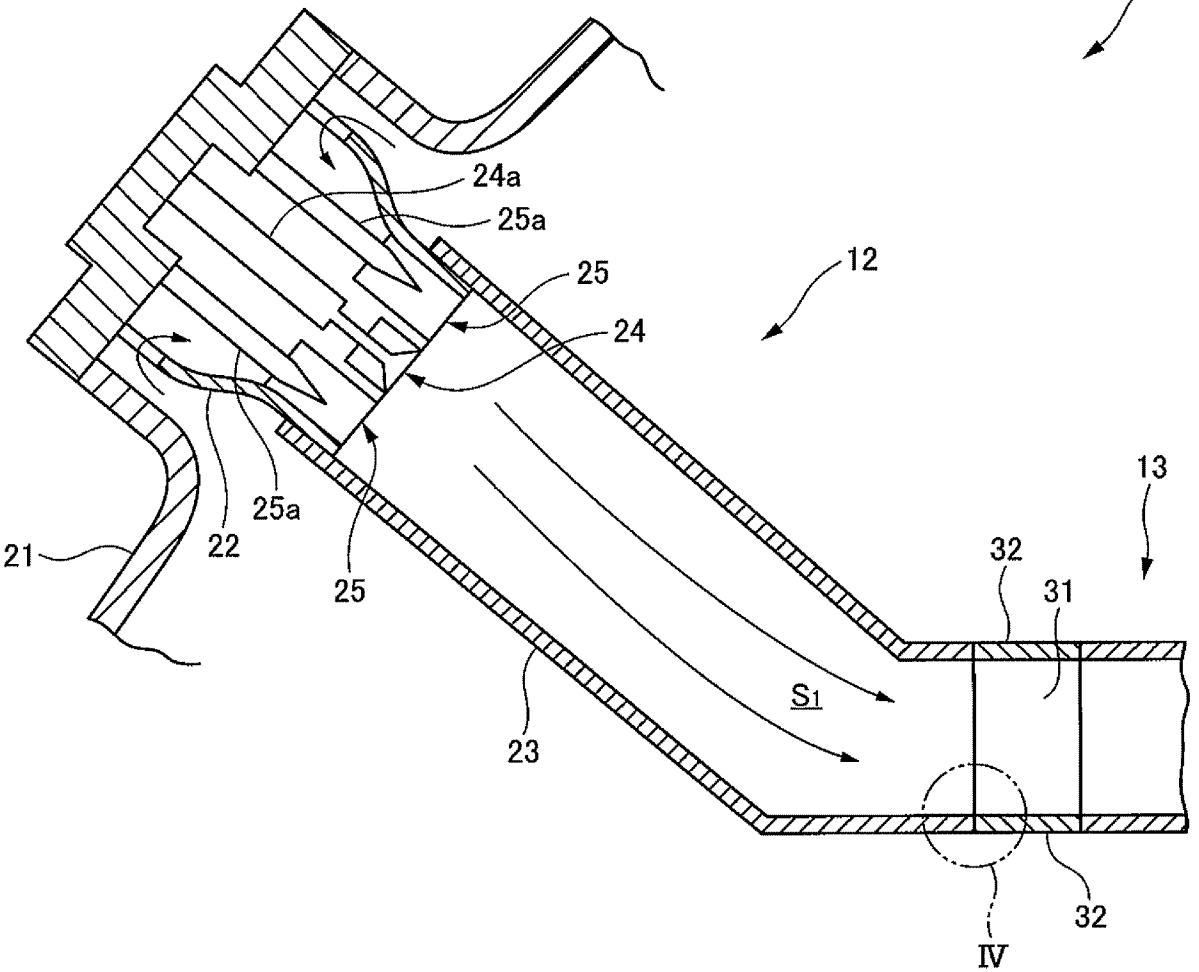
FIG. 2 is an explanatory diagram showing a structure of the combustor according to the first embodiment.

As shown in FIG. 2, the combustor 12 includes: a combustor outer pipe 21 to be connected to a not-illustrated housing; a combustor inner pipe 22 disposed inside the combustor outer pipe 21; and a combustor transition pipe 23 disposed on the downstream side in the fluid flow direction (see arrows in FIG. 2) of the combustor inner pipe 22 and connected to the turbine 13. The compressed air generated by the compressor 11 is passed through a gap between the combustor outer pipe 21 and the combustor inner pipe 22, and is supplied to a space $S_1$ inside the combustor 12 (inside the combustor inner pipe 22 and the combustor transition pipe 23).

Moreover, the combustor 12 includes a pilot burner 24 provided with a pilot nozzle 24*a*, and premix burners 25 each provided with a premix nozzle 25*a*. The compressed air supplied into the combustor transition pipe 23 is mixed with the fuel injected from the pilot nozzle 24*a* and the premix nozzles 25*a*, and then ignited and brought into combustion by the pilot burner 24 and the premix burners 25.

Here, in the gas turbine 1, the combustors 12 are arranged in a circumferential direction (see FIG. 3) such that end portions on the downstream side in the fluid flow direction (on the right near side of the sheet in FIG. 3) of the combustor transition pipes 23 draw a circle.

The turbine 13 includes stator vanes 31 supported by the not-illustrated housing, and not-illustrated rotor vanes supported by the rotor shaft 14. The rotor vanes are arranged in a circumferential direction of the rotor shaft 14 and at multiple stages in an axial direction thereof. The flow of the combustion gas generated by the combustor 12 (the combustor transition pipe 23) is straightened by the stator vanes 31 at the respective stages of the turbine 13, and is converted into force in the circumferential direction by the not-illustrated rotor vanes, thereby rotating the rotor shaft 14.

Figure 3:
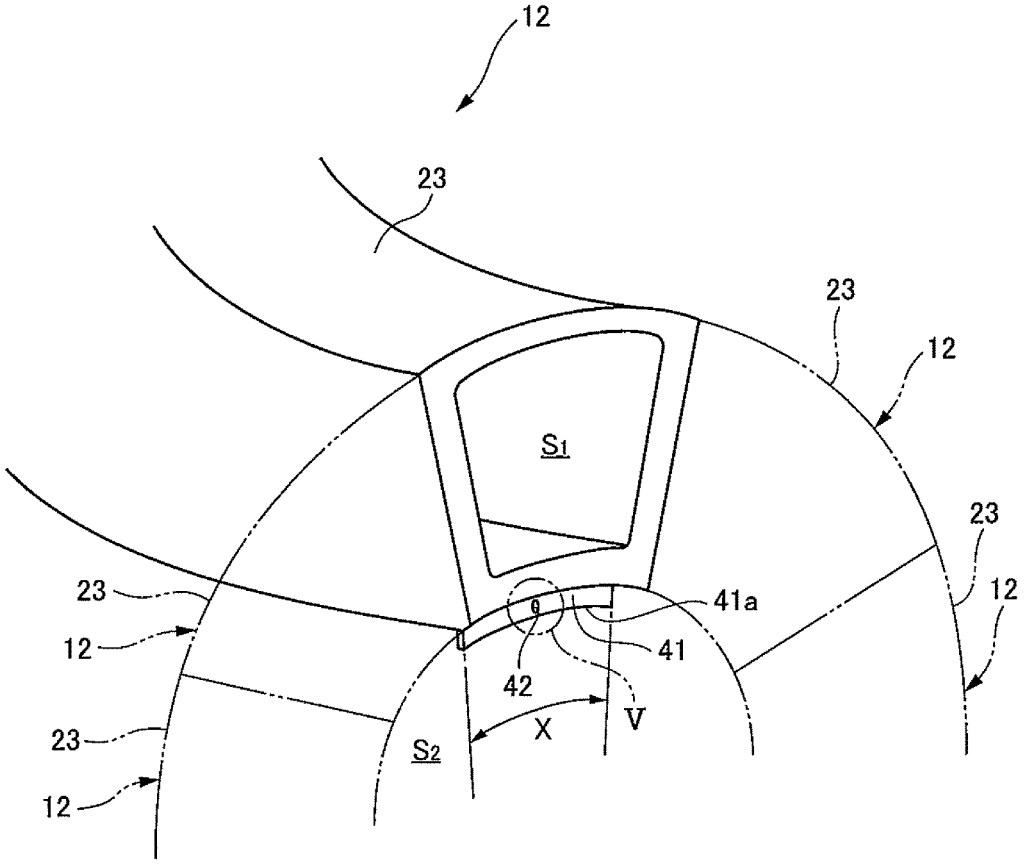
FIG. 3 is an explanatory diagram showing an end portion on a downstream side in a fluid flow direction of the combustor according to the first embodiment.
Figure 4:
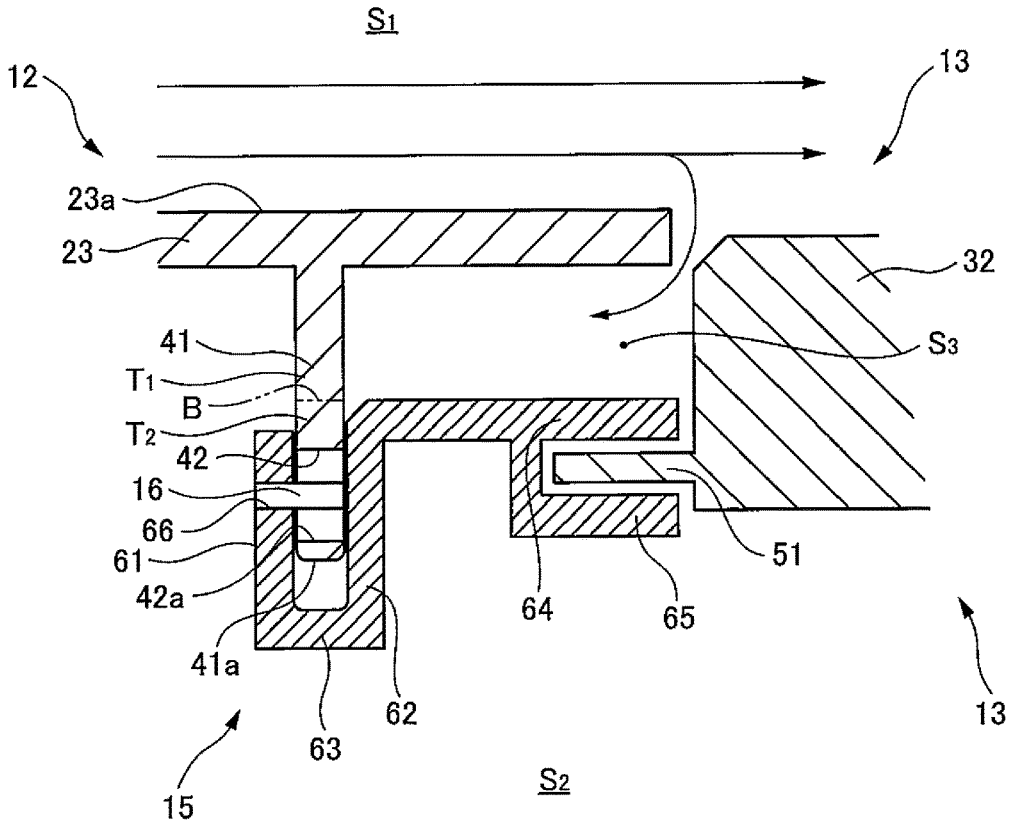
FIG. 4 is a partially enlarged diagram showing the end portion on the downstream side in the fluid flow direction of the combustor according to the first embodiment (an enlarged diagram of a portion IV in FIG. 2).

As shown in FIGS. 3 and 4, a flange portion 41 that projects toward an external space (a space in the radially inside of the combustor 12 and of the turbine 13, the space being located on a lower side in FIGS. 3 and 4) $S_2$ and extends in the circumferential direction is provided at an end portion on the downstream side (the right side in FIG. 4) in the fluid flow direction of the combustor transition pipe 23.

Meanwhile, as shown in FIG. 4, a flange portion 51 that extends in the fluid flow direction (the right-left direction in FIG. 4) toward the flange portion 41 of the combustor transition pipe 23 is provided at an end portion on an upstream side (the left side in FIG. 4) in the fluid flow direction of each shroud 32.

Here, the shrouds 32 are configured to support the radially inside and the radially outside of the stator vanes 31 in the turbine 13. The shrouds 32 for the stator vanes 31 disposed on the uppermost stream side in the fluid flow direction are opposed to the combustor transition pipe 23. Note that FIG. 4 illustrates a junction between the combustor transition pipe 23 and the shroud 32 on the radially inside of the stator vane 31.

As shown in FIG. 4, a transition pipe seal 15 is provided at the junction between the combustor 12 and the turbine 13. The transition pipe seal 15 is disposed on the radially inside at the end portion on the downstream side in the fluid flow direction of the combustor transition pipe 23, and extends in the circumferential direction along the flange portion 41 of the combustor transition pipe 23 and the flange portion 51 of the shroud 32.

The transition pipe seal 15 includes: a first radial extension portion 61 located on one side (the upstream side in the fluid flow direction and the left side in FIG. 4) of the flange portion 41 of the combustor transition pipe 23 and extending in the radial direction (the vertical direction in FIG. 4); a second radial extension portion 62 located on another side (the downstream side in the fluid flow direction and the right side in FIG. 4) of the flange portion 41 of the combustor transition pipe 23 and extending in the radial direction; and a connection portion 63 which connects rims on the radially inside (the lower side in FIG. 4) of the first radial extension portion 61 and of the second radial extension portion 62 to each other.

In other words, the first radial extension portion 61 and the second radial extension portion 62 of the transition pipe seal 15 are disposed in such a way as to sandwich the flange portion 41 of the combustor transition pipe 23 along the fluid flow direction (the axial direction of the rotor shaft 14). Thus, a position in the fluid flow direction of the transition pipe seal 15 is determined by the first radial extension portion 61 and the second radial extension portion 62.

Moreover, the transition pipe seal 15 includes: a first axial extension portion 64 and a second axial extension portion 65 projecting from the second radial extension portion 62 to the other side (the downstream side in the fluid flow direction). The first axial extension portion 64 is located on the radially outside (the upper side in FIG. 4) of the flange portion 51 of the shroud 32, and the second axial extension portion 65 is located on the radially inside of the flange portion 51 of the shroud 32.

In other words, the first axial extension portion 64 and the second axial extension portion 65 of the transition pipe seal 15 are disposed in such a way as to sandwich the flange portion 51 of the shroud 32 along the radial direction. Thus, a position in the radial direction of the transition pipe seal 15 is determined by the first axial extension portion 64 and the second axial extension portion 65.

Furthermore, the transition pipe seal 15 is brought into pinned connection to the combustor transition pipe 23 (the flange portion 41) by using a positioning pin 16. The transition pipe seal 15 is provided with a round hole 66 into which the positioning pin 16 is insertable, and the flange portion 41 is provided with an elongated hole (a pin hole) 42 which extends in the radial direction and into which the positioning pin 16 is insertable. Positioning in the circumferential direction (the front-back direction of the sheet surface in FIG. 4) of the transition pipe seal 15 relative to the combustor transition pipe 23 is established by inserting the positioning pin 16 into the round hole 66 in the transition pipe seal 15 and into the elongated hole 42 in the flange portion 41 of the combustor transition pipe 23, i.e., bringing the transition pipe seal 15 into the pinned connection to the combustor transition pipe 23 (the flange portion 41) by using the positioning pin 16.

In other words, the transition pipe seal 15 is provided between the combustor transition pipe 23 disposed on the lowermost stream side in the fluid flow direction of the combustor 12 and the shroud 32 of the stator vane 31 disposed on the uppermost stream side in the fluid flow direction of the turbine 13. The transition pipe seal 15 prevents the combustion gas, which flows from the combustor 12 to the turbine 13, from being leaked from a fluid flow passage (the space inside the combustor 12 and the turbine 13) $S_1$ for the combustion gas to an external space (the space outside the combustor 12 and the turbine 13) $S_2$.

Here, in the flange portion 41 of the combustor transition pipe 23, there are a high-temperature region (a region above a boundary B in FIG. 4) $T_1$ where a material temperature is likely to reach a high temperature, and a low-temperature region (a region below the boundary B in FIG. 4) $T_2$ where the material temperature never reaches a high temperature. As a consequence, the flange portion 41 is likely to cause a thermal stress attributed to a difference in temperature between the high-temperature region $T_1$ and the low-temperature region $T_2$. Hence, stress concentration is likely to occur on a rim 42*a* on one side (a rim on the lower side in FIG. 4) of the elongated hole 42.

In this case, the high-temperature region $T_1$ is a region which is located in the vicinity of an inner peripheral surface 23*a* exposed to the high-temperature combustion gas while the gas turbine 1 is in operation, and to which the heat is transmitted from the inner peripheral surface 23*a*. The high-temperature region $T_1$ is also likely to be exposed to the combustion gas flowing into a space $S_3$ between the combustor transition pipe 23 and the shroud 32. Meanwhile, the low-temperature region $T_2$ is a region in contact with the transition pipe seal 15, which is not exposed to the combustion gas flowing into the space $S_3$ between the combustor transition pipe 23 and the shroud 32.

Accordingly, in the gas turbine 1 including the combustor 12 of this embodiment, the flange portion 41 is provided with slits 43 and stop holes (hole portions) 44 collectively functioning as a stress relaxation structure to be described below (see FIG. 5A), and is thus configured to relax the thermal stress in the vicinity of the elongated hole 42 in the flange portion 41 of the combustor transition pipe 23, and to reduce cyclic fatigue caused by repeatedly operating and stopping the gas turbine 1.

Figure 5A:
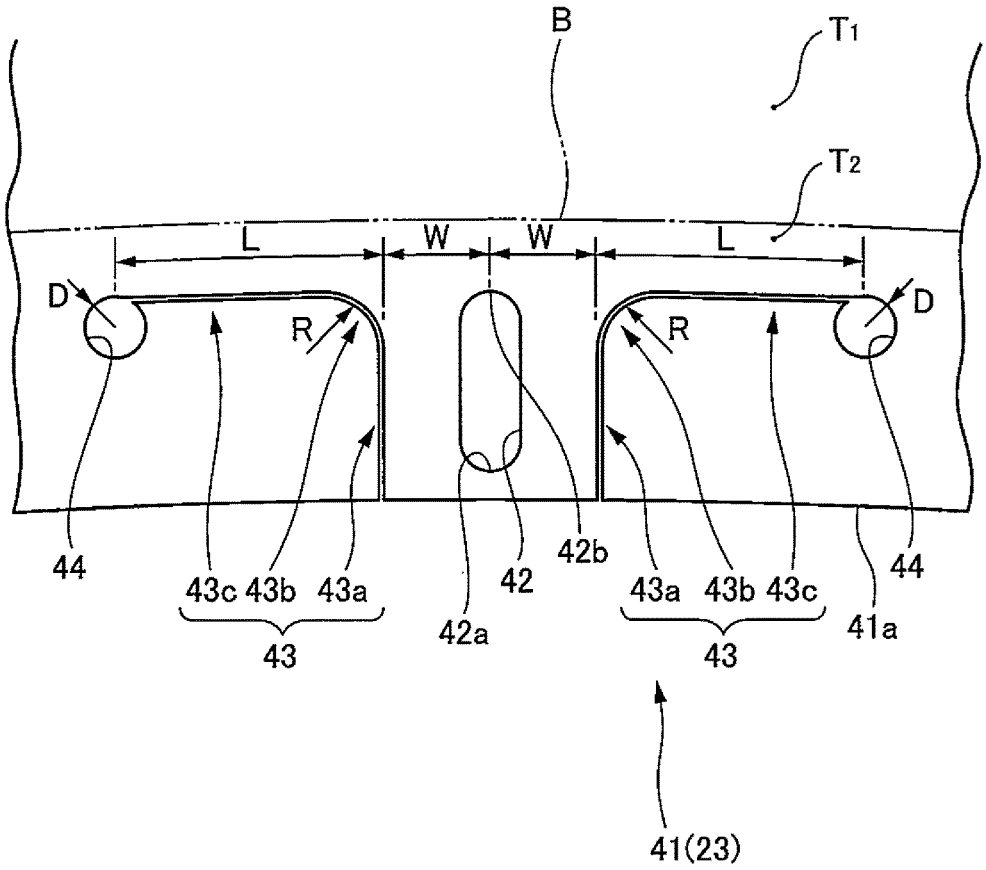
FIG. 5A is a partially enlarged diagram showing the end portion on the downstream side in the fluid flow direction of the combustor according to the first embodiment (an enlarged diagram of a portion V in FIG. 3).

As shown in FIG. 5A, the flange portion 41 is provided with the slits 43 and the stop holes 44, which are located in the vicinity of the elongated hole 42 and are formed substantially symmetrical in the circumferential direction (the right-left direction in FIG. 5A) with respect to the elongated hole 42.

Each slit 43 includes: a radial slit 43*a* (a radial slit portion) abutting on a rim 41*a* on the radially inside (the lower side in FIG. 5A) of the flange portion 41 and extending in the radial direction (the vertical direction in FIG. 5A); a curved slit (a curved slit portion) 43*b* connected to an end portion on the radially outside (an upper end portion in FIG. 5A) of the radial slit 43*a* and curved while changing its direction away from the elongated hole 42; and a circumferential slit (a circumferential slit portion) 43*c* connected to an end portion in the circumferential direction of the curved slit 43*b* and extending in the circumferential direction (a direction along the temperature boundary B).

Each stop hole 44 is formed at a position away by a predetermined distance in the circumferential direction from the elongated hole 42. Each circumferential slit 43*c* abuts on the inside of the corresponding stop hole 44.

In other words, the slit 43 is formed such that the radial slit 43*a* is continuous with the circumferential slit 43*c* via the curved slit 43*b*, and that the end portion on one side of the slit 43 abuts on the rim 41*a* of the flange portion 41 while the end portion on the other side thereof abuts on the stop hole 44.

Each circumferential slit 43*c* is formed substantially at the same position in the radial direction as a rim 42*b* on the radially outside (the upper side in FIG. 5A) of the elongated hole 42. Needless to say, the circumferential slit portions of the present invention are not limited to this configuration. The circumferential slit portions may be formed at the same position in the radial direction (within a range in the radial direction where the elongated hole 42 is formed) as any other portion of the elongated hole 42, or at a position located on the radially outside of the elongated hole 42.

The operation of the gas turbine including the combustor according to the first embodiment of the present invention will be described with reference to FIGS. 1 to 5A.

When the gas turbine 1 starts operation, the outside air is taken from a not-illustrated air intake port into the compressor 11, and the compressed air is generated by the compressor 11 (see FIG. 1). The compressed air is supplied to the combustor 12, and is mixed with the fuel and then combusted. The combustion gas generated by the combustion is sent to the turbine 13. The combustion gas is expanded in the turbine 13 and used to rotate the rotor shaft 14. Thus, the power generator 2 generates the power.

As described above, in this embodiment, the thermal energy generated by the compressor 11 and the combustor 12 of the gas turbine 1 is converted into the rotational kinetic energy by the turbine 13, and the rotational kinetic energy is converted into the electric energy by the power generator 2.

Moreover, the combustor of this embodiment is provided with the slits 43 and the stop holes 44 collectively as the stress relaxation structure (see FIG. 5A), which relax the thermal stress occurring in the vicinity of the elongated hole 42 (the rim 42*a*) in the flange portion 41 of the combustor transition pipe 23 while the gas turbine 1 is in operation, and reduce the cyclic fatigue (low-cycle fatigue) at the rim 42*a* caused by repeatedly operating and stopping the gas turbine 1.

While the gas turbine 1 is in operation, a difference in thermal strain (thermal stress) caused by the difference in temperature between the high-temperature region $T_1$ and the low-temperature region $T_2$ in the flange portion 41 occurs in a continuous material. This difference in thermal strain (the thermal stress) is relaxed by the slits 43. Meanwhile, in the vicinity of the elongated hole 42 in the flange portion 41, the thermal strain (the thermal stress) in which the low-temperature region $T_2$ is pulled by the high-temperature region $T_1$ is transmitted in a range between the slits 43 (a range at a distance (W+W) between the slits 43 in FIG. 5A).

Accordingly, as compared to a conventional flange portion (which is not provided with the slits 43 or the stop holes 44), this flange portion brings about a smaller difference in thermal strain and has a smaller range of transmission of the thermal strain (the thermal stress) to the rim 42*a* of the elongated hole 42. Thus, the thermal stress occurring on the rim 42*a* of the elongated hole 42 is relaxed.

Here, the flange portion 41 is provided with a sufficiently large circumferential length L of each circumferential slit 43*c* and with a sufficiently large inside diameter D of each stop hole 44. Thus, the flange portion 41 is configured to avoid excessive stress concentration on the periphery of each stop hole 44. Moreover, by providing a sufficiently large curvature R to each curved slit 43*b*, the flange portion 41 is configured to avoid excessive stress concentration on the periphery of the curved slit 43*b*.

Note that in this embodiment, the slits 43 and the stop holes 44 are formed in the flange portion 41 to satisfy a relation expressed in the following Formula (1), so as to avoid the excessive stress concentration on the periphery of the stop holes 44 while relaxing the thermal stress on the rim 42*a* of the elongated hole 42:

$$(X\times 1/6)<(L\times 2+W\times 2)<(X\times 1/3) \quad \text{Formula (1).}$$

Here, X is a length in the circumferential direction of the flange portion 41 (see FIG. 3), L is a distance in the circumferential direction between each radial slit 43*a* and the corresponding stop hole 44 (the circumferential length of each circumferential slit 43*c*) (see FIG. 5A), and W is a distance in the circumferential direction from the center of the elongated hole 42 to each slit 43 (the radial slit 43*a*).

In this embodiment, the flange portion 41 of the combustor transition pipe 23 is provided with the slits 43 and the stop holes 44 collectively as the stress relaxation structure. Thus, the thermal stress in the vicinity of the elongated hole 42 in the flange portion 41 of the combustor transition pipe 23 is relaxed and the cyclic fatigue is thus reduced (see FIG. 5A).

For example, it is also possible to relax the thermal stress in the vicinity of the elongated hole 42 in the flange portion 41 of the combustor transition pipe 23 and to reduce the cyclic fatigue by providing the flange portion 41 of the combustor transition pipe 23 with any of stress relaxation structures shown below (see FIGS. 5B to 5E). Note that FIGS. 5B to 5E show modified examples of the stress relaxation structure in the flange portion 41 of the combustor transition pipe 23, in which constituents having the same functions and structures as those in the above-described embodiment will be denoted by the same reference signs and overlapping explanations thereof will be omitted as appropriate.

Figure 5B:
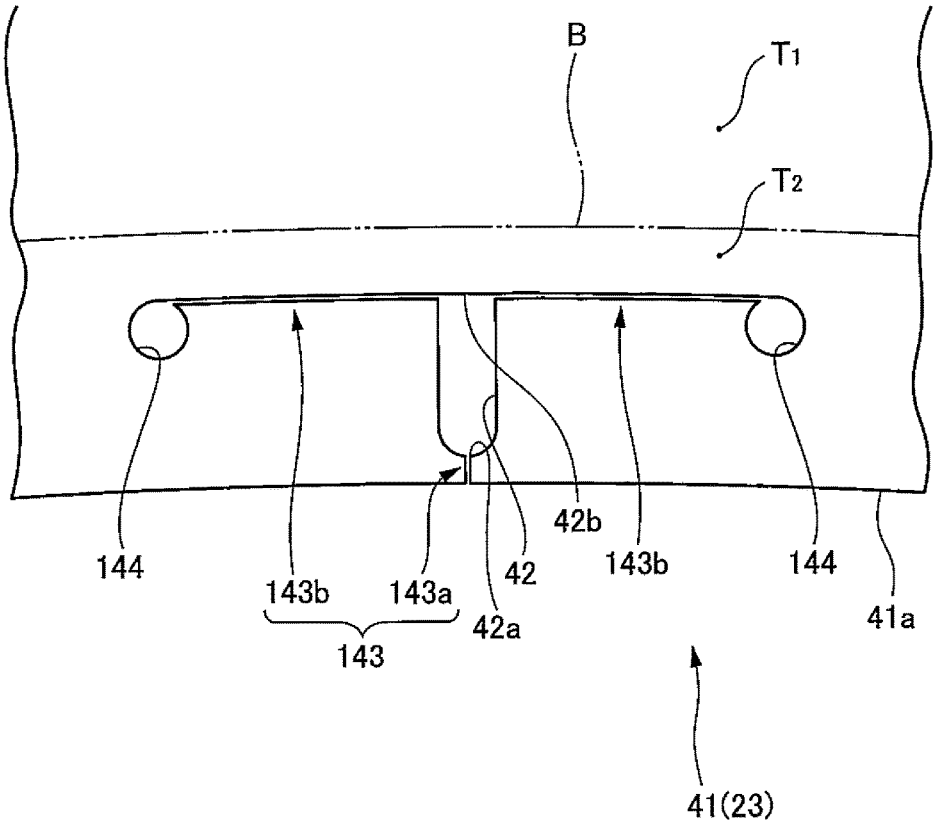
FIG. 5B is a partially enlarged diagram showing a modified example of the end portion on the downstream side in the fluid flow direction of the combustor according to the first embodiment (an enlarged diagram of the portion V in FIG. 3).

First, as shown in FIG. 5B, the flange portion 41 may be provided with slits 143 and stop holes 144 collectively as the stress relaxation structure.

The slits 143 include: a radial slit 143*a* abutting on the rim 41*a* on the radially inside (the lower side in FIG. 5B) of the flange portion 41 and extending in the radial direction (the vertical direction in FIG. 5B); and circumferential slits 143*b* each extending in the circumferential direction at the same position (within the range in the radial direction where the elongated hole 42 is formed) in the radial direction as the rim 42*b* on the radially outside (the upper side in FIG. 5B) of the elongated hole 42. Each stop hole 144 is formed at a position away by a predetermined distance in the circumferential direction from the elongated hole 42. Each circumferential slit 143*b* abuts on the inside of the corresponding stop hole 144.

The radial slit 143*a* is formed at the same position in the circumferential direction (the right-left direction in FIG. 5B) as the elongated hole 42. One end (which is an end portion on the radially outside and is an upper end portion in FIG. 5B) of the radial slit 143*a* is formed to extend to the rim 42*a* on the radially inside of the elongated hole 42 (to abut on the elongated hole 42).

One end of each of the circumferential slits 143*b* is formed to abut on the elongated hole 42. The circumferential slits 143*b* are formed substantially symmetrical in the circumferential direction with respect to the elongated hole 42 in such a way as to extend from the elongated hole 42 to one side in the circumferential direction and to the other side in the circumferential direction, respectively. Another end of each of the circumferential slits 143*b* is formed to abut on the corresponding stop hole 144.

By providing the slits 143 and the stop holes 144 collectively as the stress relaxation structure as described above, the thermal stress on the flange portion 41 (the rim 42*a* on the radially inside of the elongated hole 42) is relaxed while the gas turbine 1 is in operation, and the cyclic fatigue caused by repeatedly operating and stopping the gas turbine 1 is reduced as a consequence.

To be more precise, the rim 42*a* on the radially inside of the elongated hole 42 is split in the circumferential direction by the radial slit 143*a*. For this reason, no large thermal stress occurs in the flange portion 41 as a result of being pulled to the two sides in the circumferential direction due to the difference in thermal strain caused by the difference in temperature between the high-temperature region $T_1$ and the low-temperature region $T_2$ of the flange portion 41.

In the meantime, while the gas turbine 1 is in operation, the difference in thermal strain (the thermal stress) caused by the difference in temperature between the high-temperature region $T_1$ and the low-temperature region $T_2$ in the flange portion 41 occurs within a continuous material. This difference in thermal strain (thermal stress) is relaxed by the slits 143. Specifically, the high-temperature region $T_1$ and the low-temperature region $T_2$ of the flange portion 41 are split by the slits 143, whereby each of the regions (the high-temperature region $T_1$ and the low-temperature region $T_2$) exhibits free thermal expansion. Accordingly, the thermal stress liable to occur in the vicinity of the elongated hole 42 as a consequence of the low-temperature region $T_2$ being pulled by the high-temperature region $T_1$ is relaxed in the flange portion 41.

Figure 5C:
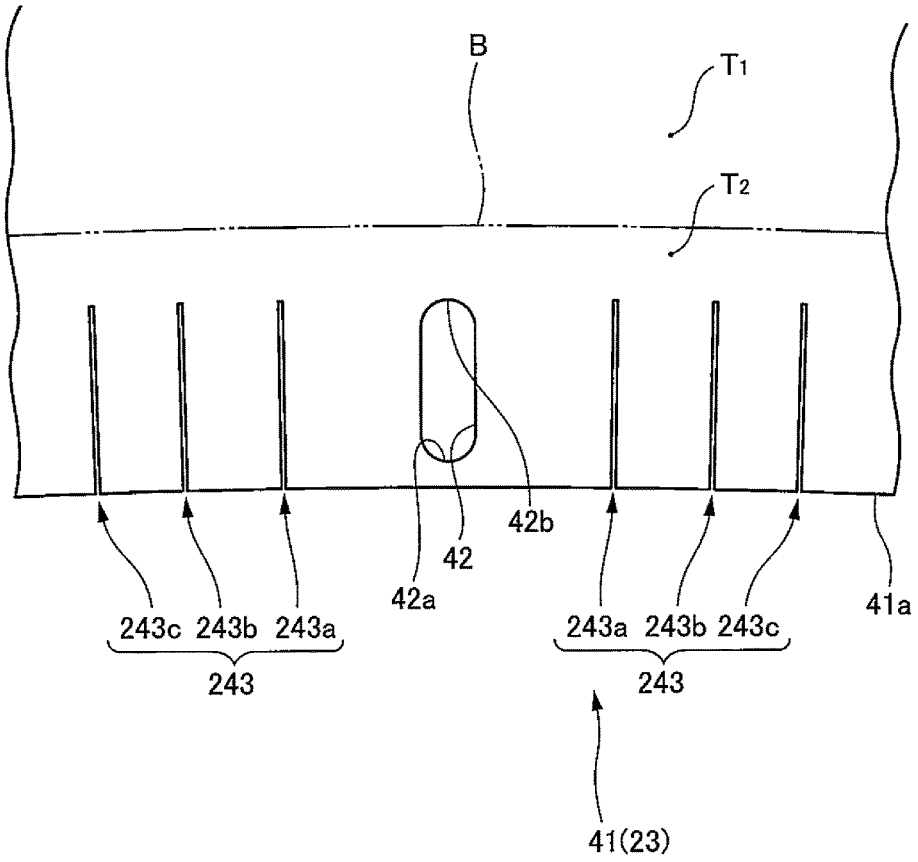
FIG. 5C is a partially enlarged diagram showing a modified example of the end portion on the downstream side in the fluid flow direction of the combustor according to the first embodiment (an enlarged diagram of the portion V in FIG. 3).

In the meantime, as shown in FIG. 5C, the flange portion 41 may be provided with slits 243 collectively as the stress relaxation structure.

The slits 243 include radial slits 243*a*, 243*b*, and 243*c* each extending in the radial direction (the vertical direction in FIG. 5C) and abutting on the rim 41*a* on the radially inside (the lower side in FIG. 5C) of the flange portion 41. Sets of the radial slits 243*a*, 243*b*, and 243*c* are provided symmetrically in the circumferential direction (the right-left direction in FIG. 5C) with respect to the elongated hole 42. The radial slits 243*a*, 243*b*, and 243*c* are arranged in the circumferential direction in the vicinity of the elongated hole 42. In the flange portion 41, first radial slits 243*a*, second radial slits 243*b*, and third radial slits 243*c* are symmetrically arranged in this order from near the elongated hole 42, respectively.

By providing the slits 243 as the stress relaxation structure as described above, the thermal stress on the flange portion 41 (the rim 42*a* on the radially inside of the elongated hole 42) is relaxed while the gas turbine 1 is in operation, and the cyclic fatigue caused by repeatedly operating and stopping the gas turbine 1 is reduced as a consequence.

To be more precise, while the gas turbine 1 is in operation, the thermal stress in which the low-temperature region $T_2$ is pulled by the high-temperature region $T_1$ is transmitted within a range between the first radial slits 243*a* in the vicinity of the elongated hole 42 of the flange portion 41.

Accordingly, as compared to a conventional flange portion (which is not provided with the slits 243 (the first radial slits 243*a*)), this flange portion has a smaller range of transmission of the thermal stress to the rim 42*a* of the elongated hole 42. Thus, the thermal stress occurring on the rim 42*a* of the elongated hole 42 is relaxed.

Moreover, since the second radial slits 243*b* and the third radial slits 243*c* are provided, the thermal stress in which the low-temperature region $T_2$ is pulled by the high-temperature region $T_1$ is transmitted in small ranges between the respective slits (between each first radial slit 243*a* and the corresponding second radial slit 243*b*, and between each second radial slit 243*b* and the corresponding third radial slit 243*c*). In other words, the thermal stress in which the low-temperature region $T_2$ is pulled by the high-temperature region $T_1$ is dispersed in the spaces between the slits 243*a*, 243*b*, and 243*c*. As a consequence, no large thermal stress (stress concentration) occurs in any part of the flange portion 41.

Figure 5D:
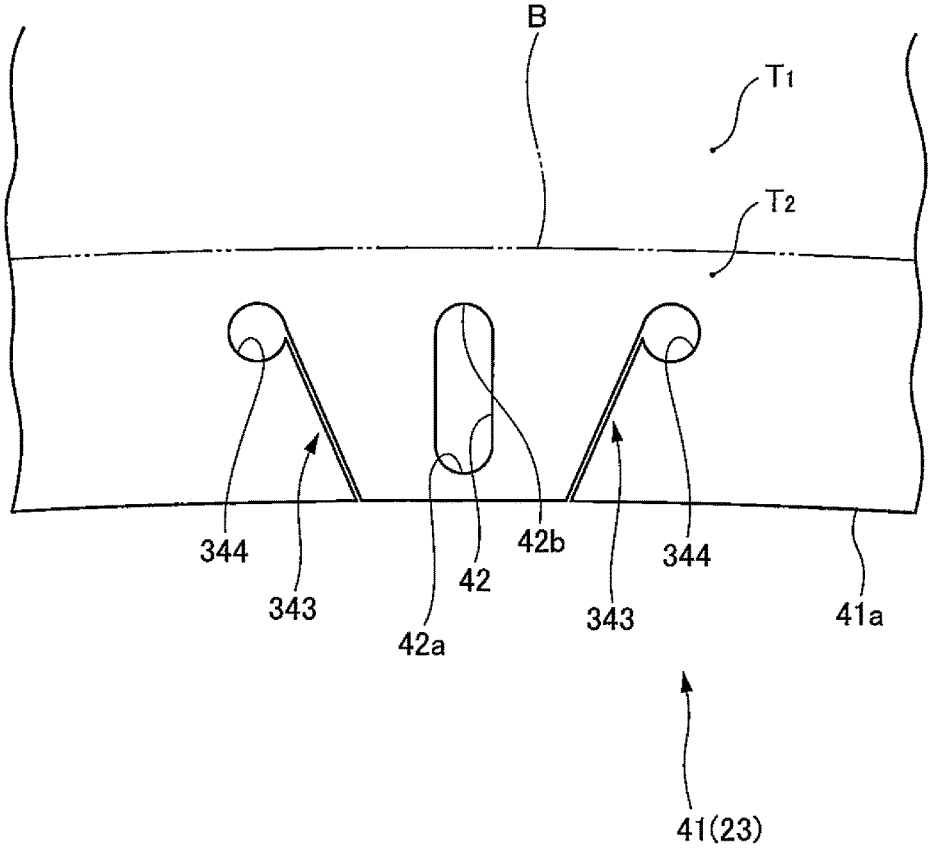
FIG. 5D is a partially enlarged diagram showing a modified example of the end portion on the downstream side in the fluid flow direction of the combustor according to the first embodiment (an enlarged diagram of the portion V in FIG. 3).

Meanwhile, as shown in FIG. 5D, the flange portion 41 may be provided with slits 343 and stop holes 344 collectively as the stress relaxation structure.

The slits 343 abut on the rim 41*a* on the radially inside (the lower side in FIG. 5D) of the flange portion 41 and extend in directions different from the radial direction (the vertical direction in FIG. 5D) and the circumferential direction (the right-left direction in FIG. 5D), and are provided symmetrical in the circumferential direction with respect to the elongated hole 42. In other words, the slits 343 are symmetrically arranged in such a way as to recede radially outward (upward in FIG. 5D) from the rim 41*a*, and to recede from each other (from the elongated hole 42) in the circumferential direction (in a spreading manner). Each stop hole 344 is formed at a position away by a predetermined distance in the circumferential direction from the elongated hole 42. Each slit 343 abuts on the inside of the corresponding stop hole 344.

By providing the slits 343 and the stop holes 344 collectively as the stress relaxation structure as described above, the thermal stress on the flange portion 41 (the rim 42*a* on the radially inside of the elongated hole 42) is relaxed while the gas turbine 1 is in operation, and the cyclic fatigue caused by repeatedly operating and stopping the gas turbine 1 is reduced as a consequence.

To be more precise, while the gas turbine 1 is in operation, the thermal stress in which the low-temperature region $T_2$ is pulled by the high-temperature region $T_1$ is transmitted within a range between the symmetrically arranged slits 343.

Accordingly, as compared to a conventional flange portion (which is not provided with the slits 343 or the stop holes 344), this flange portion has a smaller range of transmission of the thermal stress to the rim 42*a* of the elongated hole 42. Thus, the thermal stress occurring on the rim 42*a* of the elongated hole 42 is relaxed.

Moreover, since the stop holes 344 are provided, no large stress concentration occurs at an end portion on the radially outside of each slit 343.

Figure 5E:
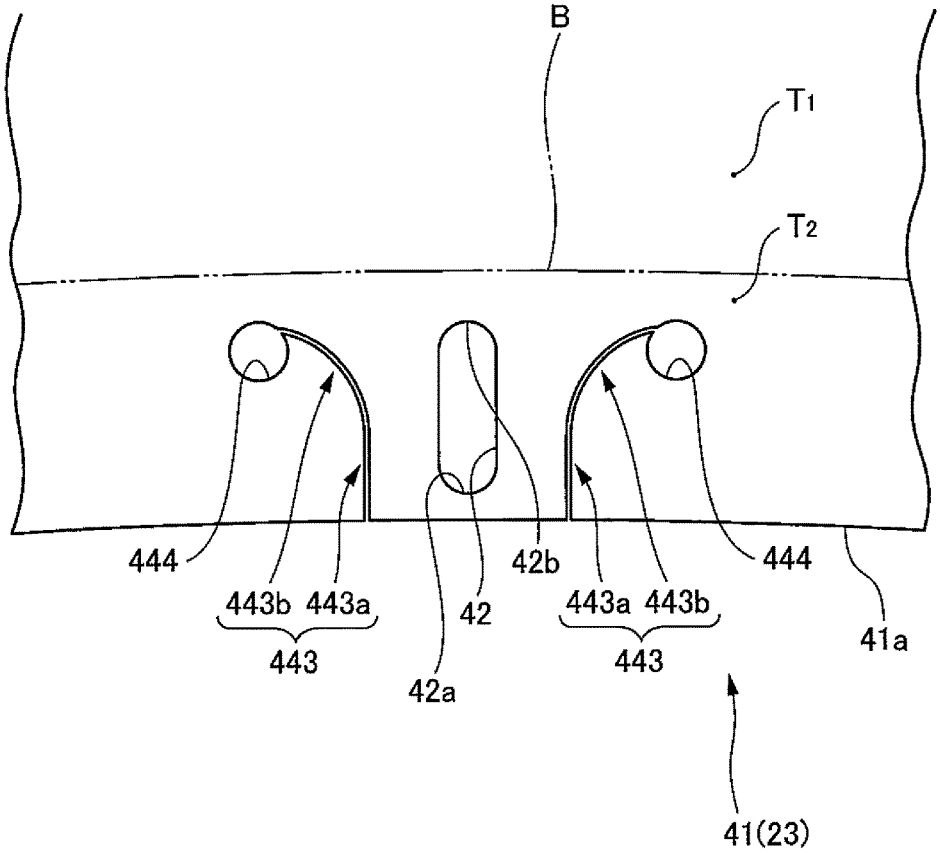
FIG. 5E is a partially enlarged diagram showing a modified example of the end portion on the downstream side in the fluid flow direction of the combustor according to the first embodiment (an enlarged diagram of the portion V in FIG. 3).

In the meantime, as shown in FIG. 5E, the flange portion 41 may be provided with slits 443 and stop holes 444 collectively as the stress relaxation structure.

Each slit 443 includes: a radial slit 443*a* abutting on the rim 41*a* on the radially inside (the lower side in FIG. 5E) of the flange portion 41 and extending in the radial direction (the vertical direction in FIG. 5E); and a curved slit 443*b* connected to an end portion on the radially outside (an upper end portion in FIG. 5E) of the radial slit 443*a* and curved while changing its direction to a direction away from the elongated hole 42. Each stop hole 444 is formed at a position away by a predetermined distance in the circumferential direction from the elongated hole 42. Each curved slit 443*b* abuts on the inside of the corresponding stop hole 444.

By providing the slits 443 and the stop holes 444 collectively as the stress relaxation structure as described above, the thermal stress on the flange portion 41 (the rim 42*a* on the radially inside of the elongated hole 42) is relaxed while the gas turbine 1 is in operation, and the cyclic fatigue caused by repeatedly operating and stopping the gas turbine 1 is reduced as a consequence.

To be more precise, while the gas turbine 1 is in operation, the thermal stress in which the low-temperature region $T_2$ is pulled by the high-temperature region $T_1$ is transmitted within a range between the slits 443 (the radial slits 443*a* and the curved slits 443*b*).

Accordingly, as compared to a conventional flange portion (which is not provided with the slits 443), this flange portion has a smaller range of transmission of the thermal stress to the rim 42*a* of the elongated hole 42. Thus, the thermal stress occurring on the rim 42*a* of the elongated hole 42 is relaxed.

Moreover, since the curved slits 443*b* are provided, no large stress concentration occurs at an end portion on the radially outside of each slit 443 (each radial slit 443*a*). Further, since the stop holes 444 are provided, no large stress concentration occurs at an end portion on the radially outside of each curved slit 443*b*.

REFERENCE SIGNS LIST

1 GAS TURBINE
2 POWER GENERATOR
11 COMPRESSOR
12 COMBUSTOR
13 TURBINE
14 ROTOR SHAFT (ROTATION SHAFT)
15 TRANSITION PIPE SEAL
16 POSITIONING PIN
21 COMBUSTOR OUTER PIPE
22 COMBUSTOR INNER PIPE
23 COMBUSTOR TRANSITION PIPE
23*a* INNER PERIPHERAL SURFACE OF COMBUSTOR TRANSITION PIPE
24 PILOT BURNER
24*a* PILOT NOZZLE
25 PREMIX BURNER
25*a* PREMIX NOZZLE
31 STATOR VANE
32 SHROUD
41 FLANGE PORTION OF COMBUSTOR TRANSITION PIPE
41*a* RIM ON RADIALLY INSIDE OF FLANGE PORTION
42 ELONGATED HOLE IN FLANGE PORTION (PIN HOLE)
42*a* RIM OF ELONGATED HOLE (RIM ON RADIALLY INSIDE)
42*b* RIM OF ELONGATED HOLE (RIM ON RADIALLY OUTSIDE)
43 SLIT OF FLANGE PORTION
43*a* RADIAL SLIT (RADIAL SLIT PORTION)
43*b* CURVED SLIT (CURVED SLIT PORTION)
43*c* CIRCUMFERENTIAL SLIT (CIRCUMFERENTIAL SLIT PORTION)
44 STOP HOLE IN FLANGE PORTION (HOLE PORTION)
51 FLANGE PORTION OF SHROUD
52 VERTICAL FLANGE PORTION OF SHROUD
53 HORIZONTAL FLANGE PORTION OF SHROUD
61 FIRST RADIAL EXTENSION PORTION OF TRANSITION PIPE SEAL
62 SECOND RADIAL EXTENSION PORTION OF TRANSITION PIPE SEAL

63 CONNECTION PORTION OF TRANSITION PIPE SEAL
64 FIRST AXIAL EXTENSION PORTION OF TRANSITION PIPE SEAL
65 SECOND AXIAL EXTENSION PORTION OF TRANSITION PIPE SEAL
66 ROUND HOLE IN TRANSITION PIPE SEAL (PIN HOLE)
143 SLIT OF FLANGE PORTION
143*a* RADIAL SLIT (RADIAL SLIT PORTION)
143*b* CIRCUMFERENTIAL SLIT (CIRCUMFERENTIAL SLIT PORTION)
144 STOP HOLE IN FLANGE PORTION (HOLE PORTION)
243 SLIT OF FLANGE PORTION
243*a* FIRST RADIAL SLIT
243*b* SECOND RADIAL SLIT
243*c* THIRD RADIAL SLIT
343 SLIT OF FLANGE PORTION
344 STOP HOLE IN FLANGE PORTION (HOLE PORTION)
443 SLIT OF FLANGE PORTION
443*a* RADIAL SLIT
443*b* CURVED SLIT
444 STOP HOLE IN FLANGE PORTION

The invention claimed is:

1. A combustor comprising:

a combustor transition pipe connected to a turbine while interposing a transition pipe seal in between, wherein the combustor transition pipe comprises a flange portion provided at an end portion on a downstream side in a fluid flow direction of the combustor transition pipe, the flange portion projecting from an outer surface of the combustor transition pipe toward an inner side in a radial direction of a shaft of the combustor and the turbine and extending in a circumferential direction, wherein the flange portion includes a pin hole into which a pin to position the transition pipe seal is inserted, a circumferential slit portion extending in the circumferential direction, the circumferential slit portion being located within a range in a radial direction where the pin hole is formed, a radial slit portion abutting on a rim on a radially inner side of the flange portion and extending in the radial direction, and a hole portion on which a first end portion of the circumferential slit portion abuts, wherein a second end portion of the circumferential slit portion that is situated opposite to the first end portion is connected to the pin hole, and a first end portion of the radial slit portion is connected to a pin hole rim on a radially inner side of the pin hole, the first end portion of the radial slit portion being opposite to a second end portion of the radial slit portion abutting on the rim on the radially inner side of the flange portion, wherein the flange portion of the combustor transition pipe is disposed so as to be opposed to a shroud of a stator vane of the turbine located on a further downstream side in the fluid flow direction of the combustor transition pipe, wherein the transition pipe seal is provided at a junction between the flange portion and the shroud, wherein the transition pipe seal is brought into connection to the flange portion by inserting the pin into a hole provided on the transition pipe seal and the pin hole provided on the flange portion, wherein the transition pipe seal extends in a circumferential direction along the flange portion, and wherein the transition pipe seal sandwiches the flange portion so as to cover an entire length of the pin hole.

2. The combustor according to claim 1, wherein the radial slit portion is formed at the same position in the circumferential direction as the pin hole.

3. The combustor according to claim 2, wherein the hole portion is one of a plurality of hole portions that are formed symmetrically in the circumferential direction with respect to the pin hole.

4. A gas turbine comprising the combustor according to claim 1.

* * * * *